US011125042B1

(12) United States Patent
Mukhlifi

(10) Patent No.: US 11,125,042 B1
(45) Date of Patent: Sep. 21, 2021

(54) TUBING HEAD ADAPTER FOR CABLE DEPLOYED (WIRELINE) ELECTRICAL SUBMERSIBLE PUMP (ESP)

(71) Applicant: Saudi Arabian Oil Company, Dhahran (SA)

(72) Inventor: Mohammed E. Mukhlifi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/889,196

(22) Filed: Jun. 1, 2020

(51) Int. Cl.

| | |
|---|---|
| ***E21B 33/04*** | (2006.01) |
| ***E21B 34/02*** | (2006.01) |
| ***E21B 33/072*** | (2006.01) |
| ***E21B 43/12*** | (2006.01) |

(52) U.S. Cl.
CPC ..... *E21B 33/0407* (2013.01); *E21B 33/072* (2013.01); *E21B 34/02* (2013.01); *E21B 43/128* (2013.01)

(58) Field of Classification Search
CPC .... E21B 33/0407; E21B 34/02; E21B 33/072; E21B 43/128
See application file for complete search history.

(56) References Cited

U.S. PATENT DOCUMENTS

| | | | | |
|---|---|---|---|---|
| 4,541,490 | A | 9/1985 | Bigbie et al. | |
| 4,562,888 | A | 1/1986 | Collet | |
| 5,148,865 | A | 9/1992 | Reed | |
| 7,913,754 | B2 * | 3/2011 | Bolding | E21B 33/068 166/90.1 |
| 8,381,820 | B2 | 2/2013 | Martinez | |
| 9,281,675 | B2 | 3/2016 | Cox | |
| 9,382,775 | B2 * | 7/2016 | Travis | E21B 33/047 |
| 9,638,006 | B2 | 5/2017 | Henschel et al. | |
| 2005/0016735 | A1 | 1/2005 | Ireland et al. | |
| 2009/0000781 | A1 | 1/2009 | Bolding | |

FOREIGN PATENT DOCUMENTS

| | | | |
|---|---|---|---|
| EP | 3358127 | A2 | 8/2018 |

OTHER PUBLICATIONS

International Search Report and Written Opinion dated Feb. 2, 2021 pertaining to International application No. PCT/US2020/057672 filed Oct. 28, 2020, 13 pgs.

* cited by examiner

*Primary Examiner* — D. Andrews
*Assistant Examiner* — Jonathan Malikasim
(74) *Attorney, Agent, or Firm* — Dinsmore & Shohl LLP

(57) ABSTRACT

A wellhead is provided comprising a fluid control tree, a tubing head spool, a tubing hanger, a back pressure valve, an ESP wireline cable hanger, and a tubing head adapter. The tubing head adapter comprises a back pressure valve profile that complements and engages an outer surface profile of the back pressure valve to fix a position of the back pressure valve in at least one direction along the longitudinal axial bore of the wellhead. The tubing head adapter comprises a cable hanger profile that complements and engages an outer surface profile of the ESP wireline cable hanger to fix a position of the ESP wireline cable hanger in at least one direction along the longitudinal axial bore of the wellhead. Methods of operating the wellhead are also provided.

19 Claims, 5 Drawing Sheets

TUBING HEAD ADAPTER FOR CABLE DEPLOYED (WIRELINE) ELECTRICAL SUBMERSIBLE PUMP (ESP)

BACKGROUND

The present disclosure generally relates to wellheads for insertion above a well and, more specifically, to wellhead tubing head adapters.

BRIEF SUMMARY

Once a well has been completed and has produced for some time, it must be monitored, maintained and, in many cases, mechanically altered in response to changing conditions. A well workover, or intervention, is a process of performing major maintenance or remedial treatments on an oil or gas well. Well workovers, or interventions, are performed by inserting tools in wellbores to conduct maintenance or remedial actions. In many cases, a workover involves the removal of the wellhead fluid control tree, after the well has been killed and a workover rig has been placed on location.

Through-tubing workover operations, using slickline, wireline, coiled tubing, snubbing, or another type of workover line, are routinely conducted to complete treatments or well service activities that avoid a full workover where the tubing is removed. This operation saves considerable time and expense. However, through-tubing workover operations can be limited.

Conventionally, through-tubing workover operations are not possible for the running and retrieval of an electrical submersible pump (ESP). Instead, to run or retrieve an ESP, a full workover, and the removal of the fluid control tree has typically been required. Thus, there has been an ongoing need for alternative equipment allowing a through-tubing running or retrieval of an ESP.

In accordance with one embodiment of the present disclosure, a wellhead for insertion above a well comprises a fluid control tree, a tubing head spool, a tubing hanger, a back pressure valve, an ESP wireline cable hanger, and a tubing head adapter. The fluid control tree comprises at least one fluid control valve to direct fluid along a longitudinal axial bore of the wellhead from tubing supported by the tubing head spool and the tubing hanger through the ESP wireline cable hanger, the tubing adapter, and the back pressure valve. The tubing head spool supports the tubing hanger and is secured to the fluid control tree via the tubing head adapter. The ESP wireline cable hanger secures the wireline cable of an ESP in the well. The tubing head adapter comprises a back pressure valve profile that complements and engages an outer surface profile of the back pressure valve to fix a position of the back pressure valve in at least one direction along the longitudinal axial bore of the wellhead. The tubing head adapter also comprises a cable hanger profile that complements and engages an outer surface of the ESP wireline cable hanger to fix a position of the ESP wireline cable hanger in at least one direction along the longitudinal axial bore of the wellhead.

A method of conducting a through-tubing workover of the wellhead comprising attaching a workover line to a new ESP and installing the new ESP in the well by running the workover line and new ESP through the longitudinal axial bore of the wellhead downhole to a first ESP and securing the workover line to the ESP cable hanger in the tubing head adapter. While conducting the through-tubing workover of the wellhead 100 the new ESP may be installed above an existing ESP in the well, the existing ESP may remain in its original position in the well, and the assembly of the fluid control tree, the tubing head spool, the tubing hanger, and the tubing head adapter may be maintained while running the workover line through the longitudinal axial bore of the wellhead.

Although the concepts of the present disclosure are described herein with primary reference to oil wells, it is contemplated that the concepts will enjoy applicability to any type of well. For example, and not by way of limitation, it is contemplated that the concepts of the present disclosure will enjoy applicability to wells for other natural resources such as ground water, brine, or natural gas.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
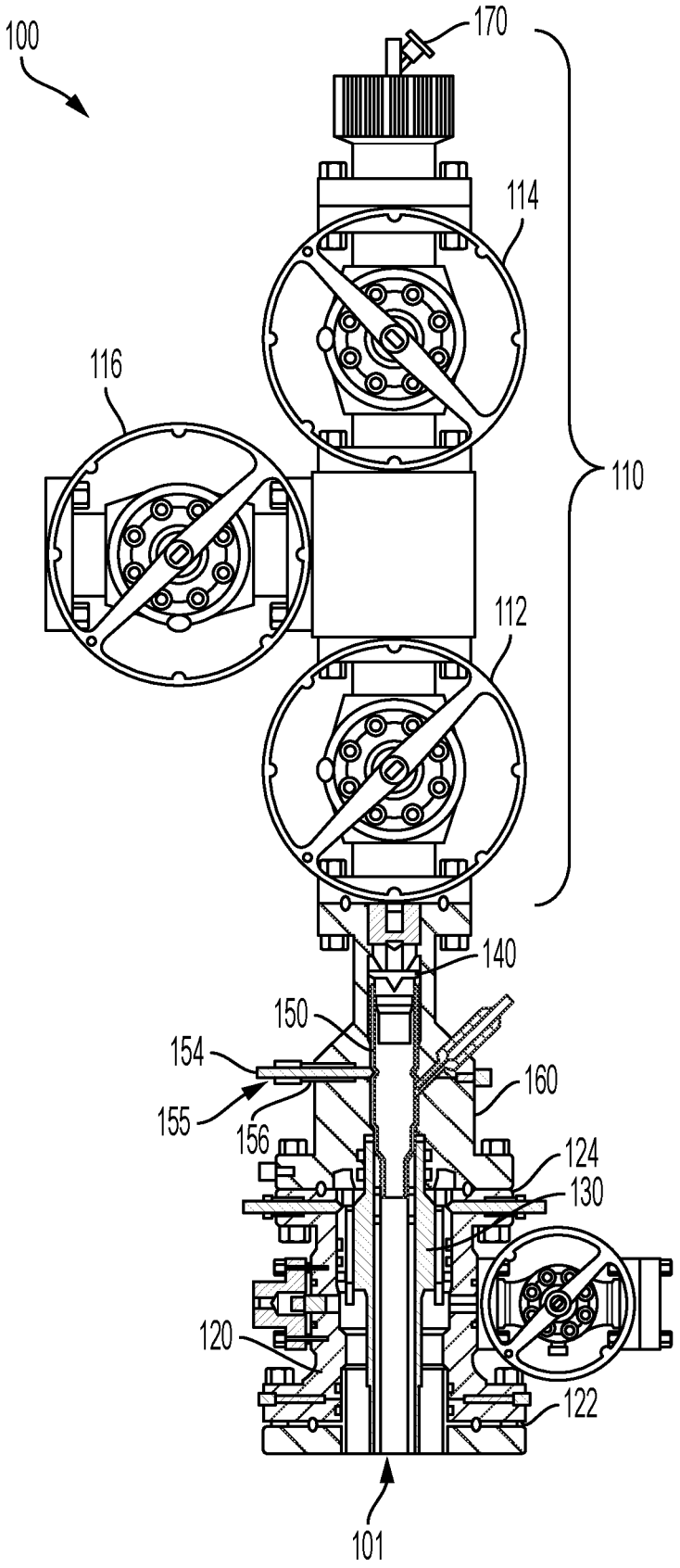
FIG. 1 is a schematic illustration of a wellhead for insertion above a well according to one embodiment of the present disclosure.
Figure 3:
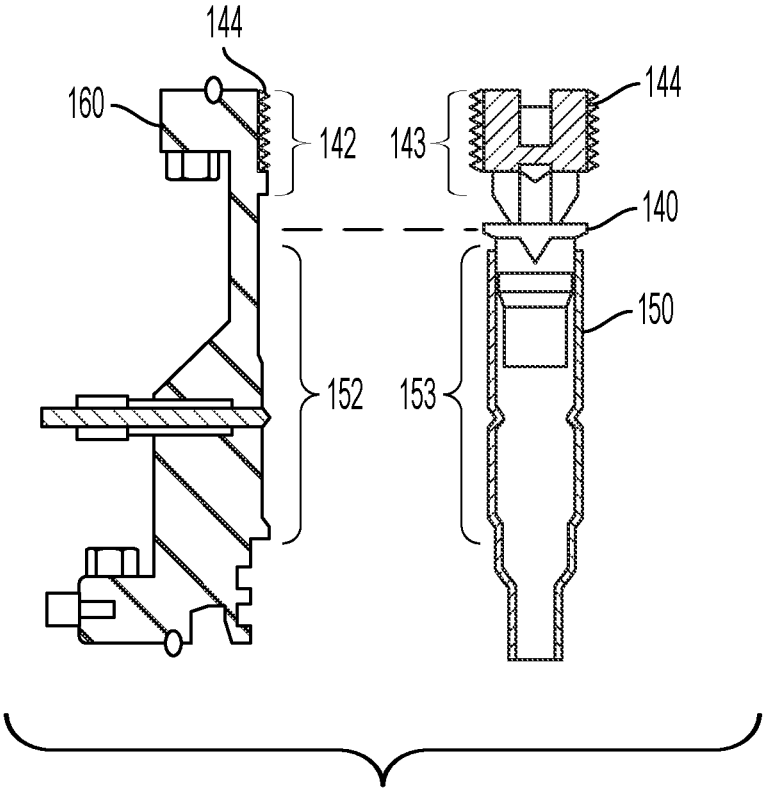
FIG. 3 is a schematic illustration of a tubing head adapter, back pressure valve, and ESP cable hanger according to one embodiment of the present disclosure.

FIG. 1 illustrates a wellhead 100 for insertion above a well. The wellhead 100 for insertion above a well comprises a fluid control tree 110, a tubing head spool 120, a tubing hanger 130, a back pressure valve 140, an ESP wireline cable hanger 150, and a tubing head adapter 160. The fluid control tree 110 comprises at least one fluid control valve to direct fluid along a longitudinal axial bore 101 of the wellhead 100 from tubing supported by the tubing head spool 120 and the tubing hanger 130 through the ESP wireline cable hanger 150, the tubing head adapter 160, and the back pressure valve 140. The tubing head spool 120 supports the tubing hanger 130 and is secured to the fluid control tree 110 via the tubing head adapter 160. The ESP wireline cable hanger 150 secures the wireline cable of an ESP (e.g., a first ESP) in the well. With reference to FIG. 3, the tubing head adapter 160 comprises a back pressure valve profile 142 that complements and engages an outer surface profile 143 of the back pressure valve 140 to fix a position of the back pressure valve 140 in at least one direction along the longitudinal axial bore 101 of the wellhead 100. Still referring to FIG. 3, the tubing head adapter 160 also comprises a cable hanger profile 152 that complements and engages an outer surface profile 153 of the ESP wireline cable hanger 150 to fix a position of the ESP wireline cable hanger 150 in at least one direction along the longitudinal axial bore 101 of the wellhead 100. The wellhead 100 may be used in either surface or offshore operations.

Figure 2:
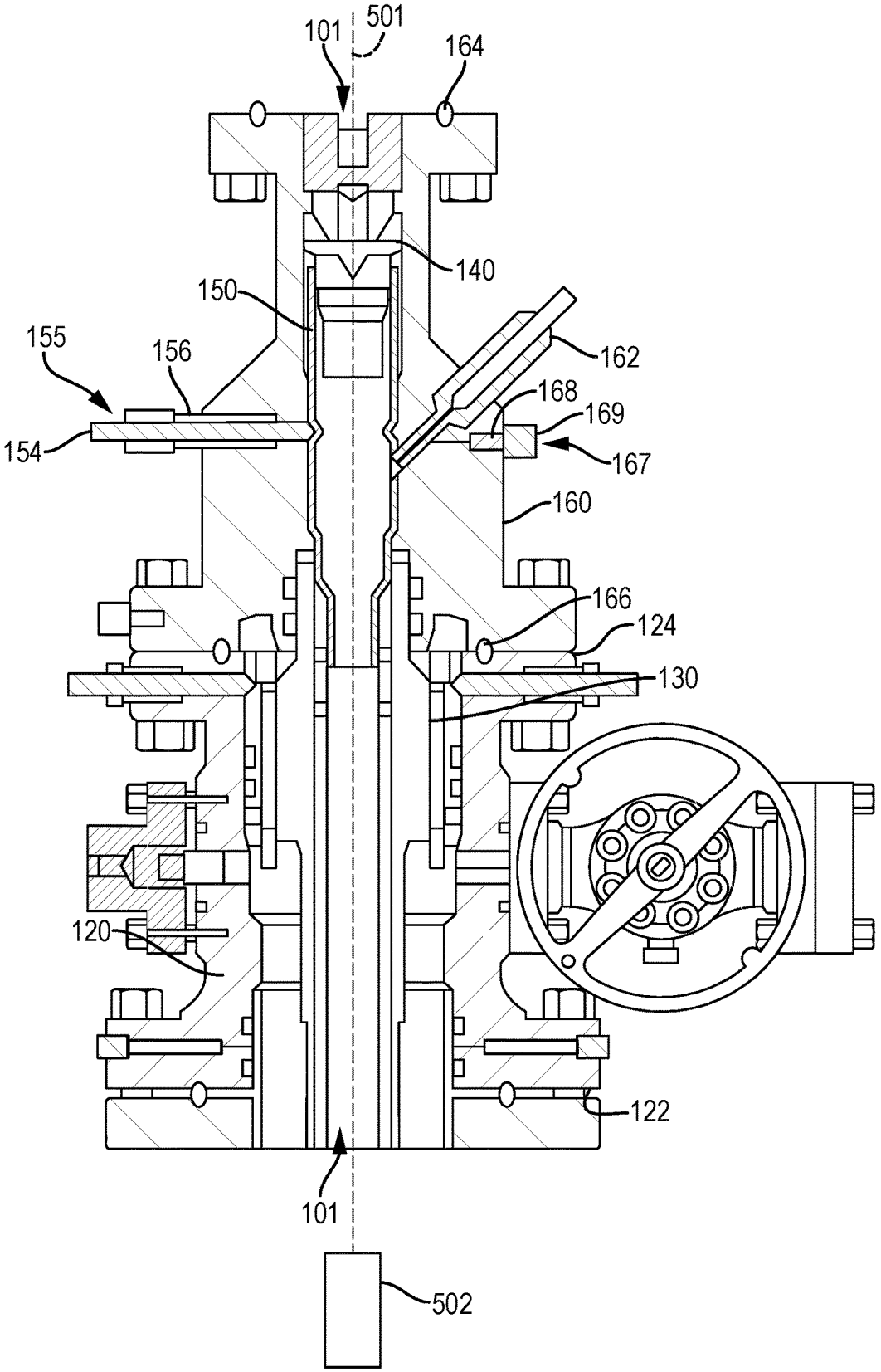
FIG. 2 is a schematic illustration of a tubing head adapter, tubing head spool, back pressure valve, and ESP cable hanger according to one embodiment of the present disclosure.

Referring to FIGS. 1-2, the fluid control tree 110 may comprise one or more master valves 112. In embodiments, the fluid control tree 110 may comprise a lower master valve and an upper master valve. In embodiments, the master valves 112 may be manually operated or hydraulically operated. For example, the lower master valve may be manually operated and the upper master valve may be hydraulically operated. The fluid control tree 110 may further comprise a right hand valve and a left hand valve 116. In embodiments, the right hand valve may provide a flow path for produced hydrocarbons to production facilities. In embodiments, the left hand valve 116 may provide a flow path for injection fluids to the wellhead 100 or formation for treatment or well-control purposes. The fluid control tree 110 may further comprise a top valve 114. In embodiments, the top valve 114 may provide a path for well interventions. In embodiments, the top valve 114 may provide a path for slickline, wireline, and coiled tubing interventions. As used throughout the present disclosure, slickline, wireline, and coiled tubing may be used interchangeably. The fluid control tree 110 may further comprise a top valve 170 secured to the top valve 114 that provides a seal to the longitudinal axial bore 101 of the wellhead 100. In order to access the path for slickline, wireline, and coiled tubing interventions, the top valve 170 may need to be removed.

Still referring to FIGS. 1-2, the tubing head spool 120 may comprise a lower flange 122 and an upper flange 124. The lower flange 122 may secure the tubing head spool 120 to a casing spool and the upper flange 124 may secure the tubing head spool 120 to the tubing head adapter 160. The tubing head spool 120 may seal pressure between a wellbore casing and a tubing annulus.

Still referring to FIGS. 1-2, the tubing hanger 130 may secure a topmost joint of a tubing string within the wellbore. In embodiments, the tubing hanger 130 and tubing head spool 120 of the wellhead 100 may comprise an ESP wireline channel, which may be a portion of the longitudinal axial bore 101, allowing the passage of the wireline cable through the tubing hanger 130 and tubing head spool 120.

Figure 4A:
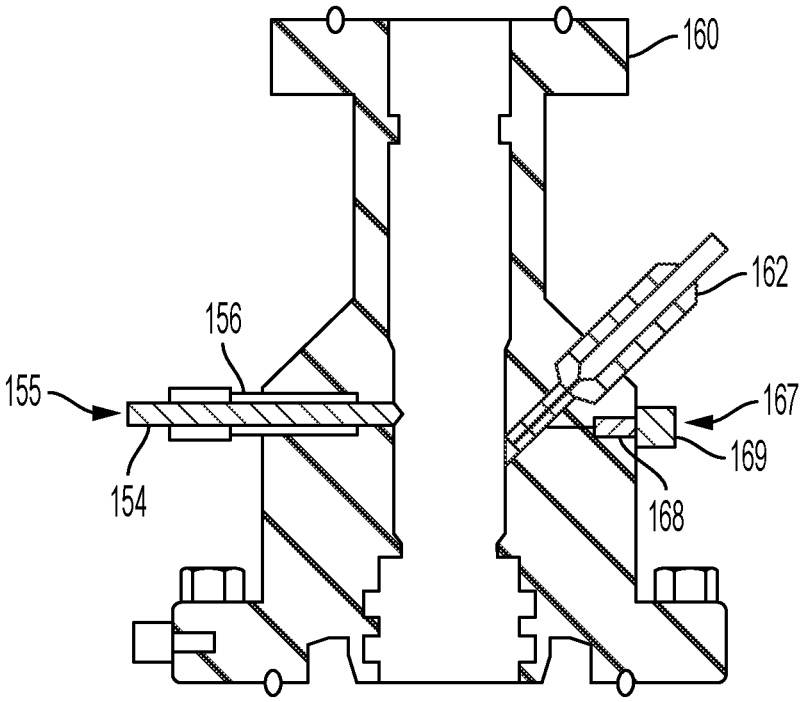
FIG. 4A is a schematic illustration of a tubing head adapter according to one embodiment of the present disclosure.
Figure 4B:
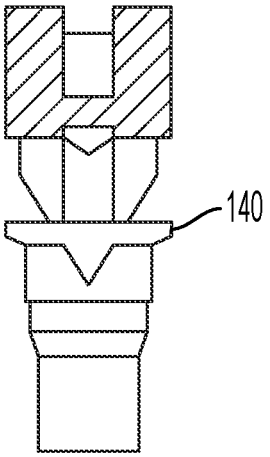
FIG. 4B is a schematic illustration of a back pressure valve according to one embodiment of the present disclosure.
Figure 4C:
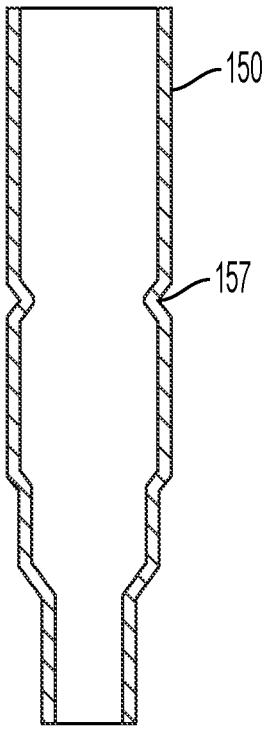
FIG. 4C is a schematic illustration of an ESP wireline cable hanger according to one embodiment of the present disclosure.

Referring to FIG. 1 and FIG. 4B, the wellhead 100 may comprise a back pressure valve 140. As used herein, a "back pressure valve" may comprise a type of check valve designed to hold pressure from one side of the valve yet enable fluids to be pumped from the other side of the valve. The back pressure valve 140 may maintain well integrity when the fluid control tree 110 is removed. The back pressure valve 140 may allow running and retrieval of the wireline ESP without obstruction. In embodiments, a synthetic seal may be positioned between the back pressure valve 140 and the back pressure valve profile 142 of the tubing head adapter 160. For example, the synthetic seal may be, but is not limited to, an elastomeric seal. Referring to FIG. 3, in embodiments, the back pressure valve 140 and the back pressure valve profile 142 of the tubing head adapter 160 are threaded and the threads 144 of the back pressure valve 140 and the back pressure valve profile 142 of the tubing head adapter 160 further secure the back pressure valve 140 to the back pressure valve profile 142 of the tubing head adapter 160.

The ESP wireline cable hanger 150 may comprise a first cable hanger seal (not shown) secured between a first outer edge of the ESP wireline cable hanger 150 and the back pressure valve profile 142 of tubing head adapter 160 and a second cable hanger seal (not shown) secured between a second outer edge of the ESP wireline cable hanger 150 and the cable hanger profile 152 of the tubing head adapter 160. The first cable hanger seal and second cable hanger seal may be synthetic seals. In embodiments, the first cable hanger seal and second cable hanger seal may be elastomeric. The tubing head adapter 160 may comprise a test port passage 168 to an annular space around the ESP wireline cable hanger 150. In embodiments, this test port passage 168 may allow for the testing of the first cable hanger seal and second cable hanger seal of the ESP wireline cable hanger 150.

Referring to FIGS. 1-3, the tubing head adapter 160 may contribute to fixing the position of the back pressure valve 140 and the ESP wireline cable hanger 150. The tubing head adapter 160 and the fluid control tree 110 may cooperate to fix a position of the back pressure valve 140 in both directions along the longitudinal axial bore 101 of the wellhead 100. The tubing head adapter 160 and the fluid control tree 110 may cooperate to fix a position of the ESP wireline cable hanger 150 in both directions along the longitudinal axial bore 101 of the wellhead 100. In embodiments, the tubing head adapter 160 may further comprise an ESP wireline cable hanger 150 locking mechanism to secure the ESP wireline cable hanger 150 in a fixed position along the longitudinal axial bore 101 of the wellhead 100. In embodiments, the tubing head adapter 160 may comprise a locking mechanism passage 156 and the cable hanger locking mechanism 155 may comprise one or more locking pins 154 extending through the locking mechanism passage 156 of the tubing head adapter 160. As used herein, "locking pins" may include, but are not limited to, screws, bolts, and other retention methods, whether conventional or yet to be developed. The one or more locking pins 154 may extend through the locking mechanism passage 156 to secure the ESP wireline cable hanger 150. In embodiments, the tubing head spool 120 and the tubing head adapter 160 may cooperate to fix a position of the tubing hanger 130 in both directions along the longitudinal axial bore 101 of the wellhead 100. In embodiments, the ESP wireline cable hanger 150 may further comprise a circumferential groove 157 and the one or more locking pins 154 may extend into the circumferential groove 157 to secure the ESP wireline cable hanger 150.

The tubing head adapter 160 may further comprises a penetrator passage 162. The ESP wireline cable hanger 150 and the penetrator passage 162 may accept the wireline cable in communication with a downhole ESP.

The tubing head adapter 160 may further comprise various seals. In embodiments, the tubing head adapter 160 may further comprise a first adapter seal 164 secured between the fluid control tree 110 and the tubing head adapter 160 and a second adapter seal 166 secured between the tubing head adapter 160 and the tubing head spool 120. Various types of seals may be used in the tubing head adapter 160. In embodiments, the first adapter seal 164 and the second adapter seal 166 may be elastomeric seals. In other embodiments, the first adapter seal 164 and the second adapter seal 166 may be a metal-to-metal seal.

The tubing head adapter 160 may further comprise a test port 167. The tubing head adapter 160 may further comprise a test port passage 168 the wellhead 100 further comprises a test fitting 169 extending through the test port passage 168. In embodiments, a plurality of test port passages 168 and test fittings 169 are contemplated. The location and arrangement of the test port passage 168 and test fitting 169 may allow for the testing of one or more of a tubing head adapter seal, a wireline ESP cable hanger seal, and an ESP penetrator. To utilize a test port 167, fluid may be pumped in to the test fitting 169 through the test port passage 168 into an annular space (such as the longitudinal axial bore 101) between a first component and a second component. Pressure in this annular space may be raised to a value above that which will be observed during operation. For example, fluid may be pumped in to a test fitting 169 through a test port passage 168 into the annular space between the fluid control tree 110 and the tubing head spool 120. The pressure in the longitudinal axial bore 101 of the tubing head adapter 160 may then be raised to above that which will be observed during operation to test the seal of the tubing head adapter 160.

Figure 5:
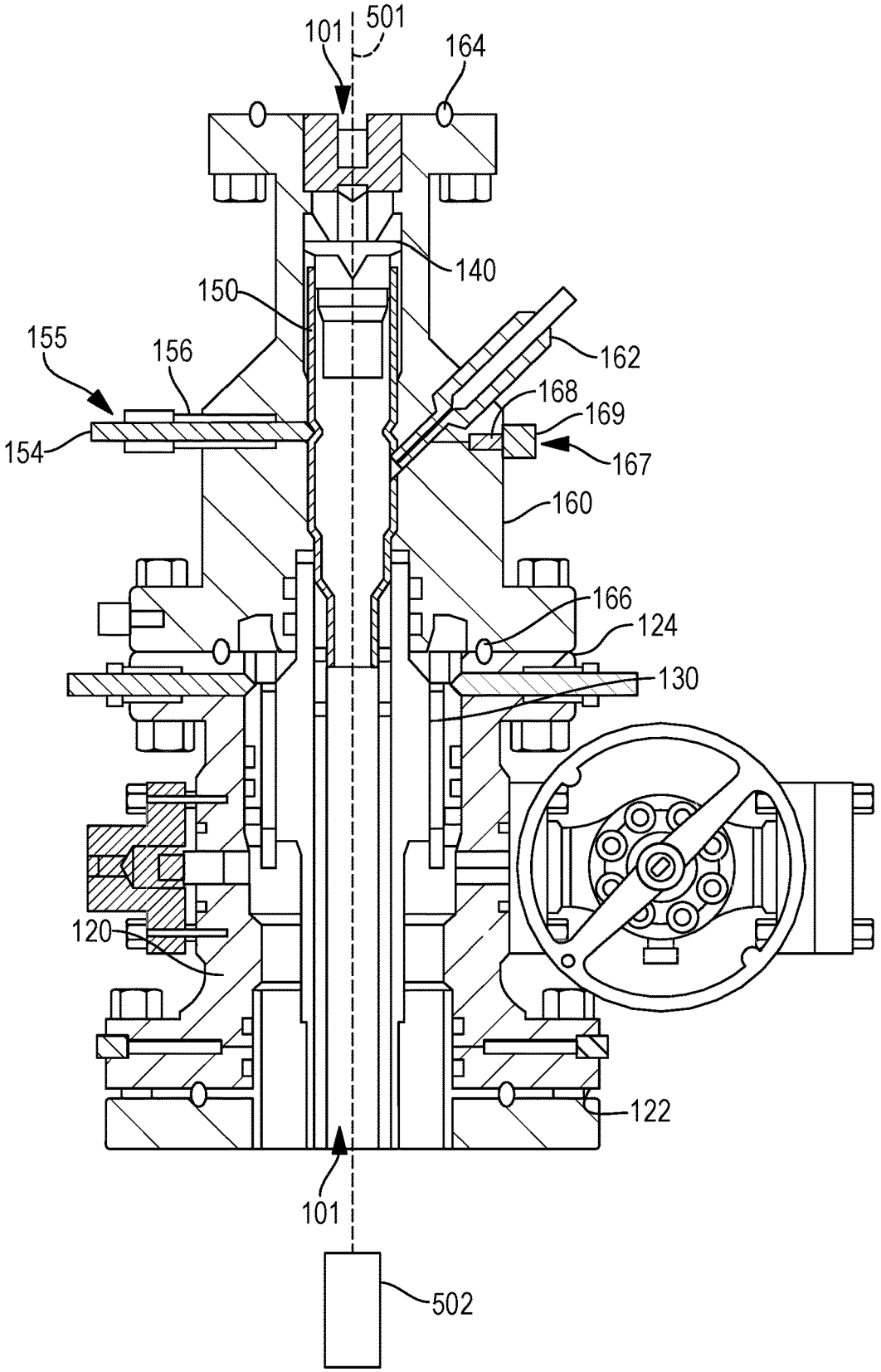
FIG. 5 is a schematic illustration of a tubing head adapter, tubing head spool, back pressure valve, and ESP cable hanger, as well as a wireline and new ESP according to one embodiment of the present disclosure.

Referring now to FIG. 5, a method of conducting a through-tubing workover of the wellhead 100 comprising attaching a workover line 501 to a new ESP 502 and installing the new ESP 502 in the well by running the workover line 501 and new ESP 502 through the longitudinal axial bore 101 of the wellhead 100 downhole to a first ESP and securing the workover line 501 to the ESP cable hanger 150 in the tubing head adapter 160. While conducting the through-tubing workover of the wellhead 100 the new ESP 502 may be installed above first ESP in the well, the first ESP may remain in its original position in the well, and the assembly of the fluid control tree 110, the tubing head spool 120, the tubing hanger 130, and the tubing head adapter 160 may be maintained while running the workover line through the longitudinal axial bore 101 of the wellhead 100.

The method of conducting a through-tubing workover of the wellhead 100 may further comprise removing a fluid control tree cap of the fluid control tree 110, such as the top valve 170 and installing a workover line assembly above the fluid control tree 110.

It is also noted that recitations herein of "at least one" component, element, etc., should not be used to create an inference that the alternative use of the articles "a" or "an" should be limited to a single component, element, etc.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A wellhead for insertion above a well comprising
a fluid control tree,
a tubing head spool,
a tubing hanger,
a back pressure valve,
an electrical submersible pump (ESP) wireline cable hanger, and
a tubing head adapter, wherein:
the fluid control tree comprises at least one fluid control valve to direct fluid along a longitudinal axial bore of the wellhead from tubing supported by the tubing head spool and the tubing hanger through the ESP wireline cable hanger, the tubing adapter, and the back pressure valve;
the tubing head spool supports the tubing hanger and is secured to the fluid control tree via the tubing head adapter;
the ESP wireline cable hanger secures a wireline cable of a first ESP in the well;
the tubing head adapter comprises a back pressure valve profile that complements and engages an outer surface profile of the back pressure valve to fix a position of the back pressure valve in at least one direction along the longitudinal axial bore of the wellhead; and
the tubing head adapter comprises a cable hanger profile that complements and engages an outer surface profile of the ESP wireline cable hanger to fix a position of the ESP wireline cable hanger in the at least one direction along the longitudinal axial bore of the wellhead.

2. The wellhead of claim 1, wherein the tubing head adapter and the fluid control tree cooperate to fix a position of the back pressure valve in both directions along the longitudinal axial bore of the wellhead.

3. The wellhead of claim 1, wherein the tubing head adapter and the fluid control tree cooperate to fix a position of the ESP wireline cable hanger in both directions along the longitudinal axial bore of the wellhead.

4. The wellhead of claim 1, wherein the tubing head adapter further comprises an ESP wireline cable hanger locking mechanism to secure the ESP wireline cable hanger in a fixed position along the longitudinal axial bore of the wellhead.

5. The wellhead of claim 4, wherein:
the tubing head adapter comprises a locking mechanism passage; and
the cable hanger locking mechanism comprises one or more locking pins extending through the locking mechanism passage of the tubing head adapter.

6. The wellhead of claim 5, wherein the one or more locking pins extend through the locking mechanism passage to secure the ESP wireline cable hanger.

7. The wellhead of claim 6, wherein the ESP cable hanger further comprises a circumferential groove and the one or more locking pins extend into the circumferential groove to secure the ESP wireline cable hanger.

8. The wellhead of claim 1, wherein the tubing head adapter further comprises a penetrator passage with the ESP wireline cable hanger and the penetrator passage accepts the wireline cable in communication with the downhole ESP.

9. The wellhead of claim 1, wherein the tubing head adapter further comprises:
a first adapter seal secured between the fluid control tree and the tubing head adapter; and
a second adapter seal secured between the tubing head adapter and the tubing head spool.

10. The wellhead of claim 1, wherein:

the tubing head adapter further comprises a test port passage; and the wellhead further comprises a test fitting extending through the test port passage.

11. The wellhead of claim 1, wherein:

the tubing head spool comprises a lower and an upper flange, where:

the lower flange secures the tubing head spool to a casing spool; and the upper flange secures the tubing head spool to the tubing head adapter.

12. The wellhead of claim 1, wherein the tubing head spool seals pressure between a wellbore casing and a tubing annulus.

13. The wellhead of claim 1, wherein the tubing hanger secures a topmost joint of a tubing string within the wellbore.

14. The wellhead of claim 1, wherein the tubing hanger comprises an ESP wireline channel allowing the passage of the wireline cable through the tubing hanger and tubing hanger spool.

15. The wellhead of claim 1, wherein the back pressure valve and the back pressure valve profile of the tubing head adapter are threaded and the threads of the back pressure valve and the back pressure valve profile of the tubing head adapter further secure the back pressure valve to the back pressure valve profile of the tubing head adapter.

16. The wellhead of claim 1, wherein the tubing head adapter comprises a test port passage to an annular space around the ESP wireline cable hanger.

17. A method of conducting a through-tubing workover of the wellhead of claim 1, the method comprising:

attaching a workover line to a new ESP and installing the new ESP in the well by running the workover line and new ESP through the longitudinal axial bore of the wellhead downhole to the first ESP; and securing the workover line to the ESP cable hanger in the tubing head adapter, wherein the new ESP is installed above the first ESP in the well, the first ESP remains in its original position in the well, and the assembly of the fluid control tree, the tubing head spool, the tubing hanger, and the tubing head adapter is maintained while running the workover line through the longitudinal axial bore of the wellhead.

18. The method of claim 17, further comprising:

removing a fluid control tree cap of the fluid control tree; and installing a workover line assembly above the fluid control tree.

19. A wellhead for insertion above a well comprising a fluid control tree, a tubing head spool, a tubing hanger, a back pressure valve, an electrical submersible pump (ESP) wireline cable hanger, and a tubing head adapter, wherein:

the fluid control tree comprises at least one fluid control valve to direct fluid along a longitudinal axial bore of the wellhead from tubing supported by the tubing head spool and the tubing hanger through the ESP wireline cable hanger, the tubing adapter, and the back pressure valve;

the tubing head spool supports the tubing hanger and is secured to the fluid control tree via the tubing head adapter;

the ESP wireline cable hanger secures a wireline cable of an ESP in the well;

the tubing head adapter comprises a back pressure valve profile that complements and engages an outer surface profile of the back pressure valve to fix a position of the back pressure valve in at least one direction along the longitudinal axial bore of the wellhead;

the tubing head adapter comprises a cable hanger profile that complements and engages an outer surface profile of the ESP wireline cable hanger to fix a position of the ESP wireline cable hanger in at least one direction along the longitudinal axial bore of the wellhead;

a first adapter seal secured between the fluid control tree and the tubing head adapter;

a second adapter seal secured between the tubing head adapter and the tubing head spool;

the tubing head adapter further comprises a test port passage;

the wellhead further comprises a test fitting extending through the test port passage;

the tubing hanger comprises an ESP wireline channel allowing the passage of the wireline cable through the tubing hanger and tubing hanger spool;

the tubing head adapter comprises a locking mechanism passage;

a cable hanger locking mechanism comprises one or more locking pins extending through the locking mechanism passage of the tubing head adapter; and the ESP cable hanger comprises a circumferential groove and the one or more locking pins extend into the circumferential groove to secure the ESP wireline cable hanger.

* * * * *